United States Patent [19]

Kamohara et al.

[11] Patent Number: 4,832,707

[45] Date of Patent: May 23, 1989

[54] METAL-BONDED TOOL AND METHOD OF MANUFACTURING SAME

[75] Inventors: Hisato Kamohara, Yokohama; Kagetaka Amano, Atsugi; Hiromichi Horie, Yokosuka; Keizo Shimamura, Kawasaki; Tatsuyoshi Aisaka, Ebina, all of Japan

[73] Assignee: Kabushiki Kaisha Toshiba, Kawasaki, Japan

[21] Appl. No.: 195,868

[22] Filed: May 19, 1988

[30] Foreign Application Priority Data

May 19, 1987 [JP] Japan ..... 62-120146
Dec. 11, 1987 [JP] Japan ..... 62-311888

[51] Int. Cl.[4] ..... B24D 3/02
[52] U.S. Cl. ..... 51/307; 51/293; 51/295; 51/309
[58] Field of Search ..... 51/293, 295, 307, 309

[56] References Cited

U.S. PATENT DOCUMENTS

| | | | |
|---|---|---|---|
| 3,868,234 | 2/1975 | Fontanella | 51/309 |
| 4,024,675 | 5/1977 | Naidich et al. | 51/307 |
| 4,168,957 | 9/1979 | Lee et al. | 51/309 |
| 4,241,135 | 12/1980 | Lee et al. | 51/307 |
| 4,246,006 | 1/1981 | Phaal | 51/307 |
| 4,247,304 | 1/1981 | Morelock | 51/295 |
| 4,378,975 | 4/1983 | Tomlinson et al. | 51/307 |
| 4,440,573 | 4/1984 | Ishizuka | 51/307 |
| 4,515,746 | 5/1985 | Brun et al. | 51/307 |

*Primary Examiner*—Paul Lieberman
*Assistant Examiner*—Willie J. Thompson
*Attorney, Agent, or Firm*—Oblon, Fisher, Spivak, McClelland & Maier

[57] ABSTRACT

This invention provides a metal-bonded tool in which iron-base alloy powder and abrasive grains are bonded to each other. The quantity of the carbon or graphite in the bond being between 2.5 wt % or more and 4.5 wt % or less of the bond, and the diameter of the precipitated carbon or graphite being 5 μm or less in the bond.

21 Claims, No Drawings

METAL-BONDED TOOL AND METHOD OF MANUFACTURING SAME

BACKGROUND OF THE INVENTION

1. Field of the Invention

This invention relates generally to a metal-bonded tool and a method of manufacturing same, and more particularly to a metal-bonded tool which uses an iron-base alloy as a bond to which abrasive grains are bonded.

2. Description of the Prior Art

Metal-bonded diamond tools which use diamond as abrasive grains have been available for grinding or finishing a variety of ceramics such as alumina, aluminum nitride, and silicon nitride. Also, metal-bonded boron nitride tools whose abrasive grains are cubic boron nitride (CBN), are considered to be effective for grinding or finishing hard metals. In metal-bonded diamond tools which use diamond powder as abrasive grains, the bonding strength of their bonds and abrasive grains are provided by sintering after mixing metallic powder or metallic powder containing metallic compounds and abrasive made of diamond powder.

In the case of metal-bonded diamond tools suitable for high efficiency grinding, the powder is made by pulverizing the chips of iron-base casting containing carbon in a ball mill or by stamping. In the powder made by these methods, the sizes of the carbon or graphite precipitates is large, e.g. from dozens to 100 μm, and the shapes are uneven. Therefore, carbon or graphite precipitates in the powder are apt to dropout during pulverization, and carbon in the powder becomes uneven. The diameter of carbon or graphite precipitates of tool materials is larger. Therefore, the loss of carbon or graphite precipitates creates hollows, and grinding or finishing chips accumulate in the hollows. This causes the destruction or the plastic deformation of bond by galling. These are the causes of lower grinding efficiency or finishing accuracy.

In processes of manufacturing diamond tools, carbon or graphite powder has been added to disperse in the sinter. However, the above problems could not be solved, because it was difficult to disperse very small carbon grains evenly into the material.

As stated above, the conventional tools experience a loss of carbon or graphite precipitates, leading to the loss of abrasive grains, and this causes lower grinding efficiency or finishing accuracy.

SUMMARY OF THE INVENTION

It is an object of the invention to provide an improved metal-bonded tool and a method of manufacturing same which is to solve the above-mentioned problems and is to provide a metal-bonded tool with subltantially loss no, higher grinding and finishing efficiency and higher finishing accuracy.

This invention provides a metal-bonded tool in which iron-base alloy powder to be the bond and abrasive grains are bonded to each other, characterized by the quantity of the carbon or graphite in said bond being between 2.5 wt % or more and 4.5 wt % or less of the bond, and the diameter of said precipitated carbon or graphite being 5 μm or less in said bond.

DESCRIPTION OF THE PREFERRED EMBODIMENTS

The present inventors have found that the above-mentioned problems comes from the shape of the carbon or graphite in the bonds. According to the invention, this problem is solved by regulating the quantity of the carbon or graphite and the size of said precipitates in the bond.

According to the invention, the quantity of the carbon or graphite contained in the iron-base alloy forming the bond is regulated to be between 2.5 wt % and 4.5 wt %, because its self-lubrication will decrease and the strength of the bond metal will be smaller if the quantity of the carbon or graphite is less than 2.5 wt %, while the strength of the tool will be less if the quantity of the carbon or graphite is more than 4.5 wt %. Therefore, the quantity of the carbon or graphite is regulated to such an extent. In the invention, the size of carbon or graphite precipitates in the bonds should be 5 μm or less. This results in suppressing the loss of said precipitates. As a result, the loss of the abrasive grains can be prevented and the sufficient self-lubrication can be maintained. Also, the frequency of dressing can be remarkably decreased.

Further, there can be a few carbon or graphite grains which are more than 5 μm without any effect. That is to say, if 90% or more carbon or graphite grains have a size of 5 μm or less, there are substantially no problems. The ratio, "90% or more" is reduced by the ratio of an area in a cross section.

As for the relation to said abrasive grains, the diameter of the precipitated carbon or graphite grains dispersed in the bond will be preferable if 90% or more carbon or graphite are 1/10 or less of the average diameter of said abrasive grains. If the diameter of carbon or graphite is out of this range, the abrasive grains will be subject to be surrounded by the carbon or graphite grains, causing the loss of the abrasive grains during grinding.

The main ingredient of said iron-base alloy which constructs said bond is preferably a ferrite phase. If the matrix in itself were not a ferrite phase containing carbon or graphite, a tool having sufficient density cannot be obtained. The bending strength of bond metal hot pressing is desired to be 60 kg/mm$^2$. If the strength of the bond is less than 60 kg/mm$^2$, the bonding strength for the abrasive grains will decrease, resulting in the loss of said abrasive grains. Therefore, it is difficult to obtain the high grinding efficiency based on the high infeed grinding.

According to the invention, the iron-base alloy used in the invention may be acceptable if it contains carbon to the above-mentioned extent. The effect of the invention can be obtained by controlling the size of carbon or graphite precipitates. The bond material is selectable from conventional iron-base alloys and is permitable unavoidable impurities such as manganese or magnesium. However, it is desirable that silicon is used as the alloy composition and added to the extent of that;

$$3 \leqq (B+A/3) \leqq 5,$$

where silicon is A wt % and carbon or graphite is B wt % in the bond. This results in accelerating carbon or graphite precipitation and improving the effect of the invention. If the quantity of silicon is less than this, cementite may react more often because the effect of the carbon or graphite precipitates will be smaller. Also, on the other hand, in case of being over this extent, the sintering efficiency will be decreased. The quantity of silicon is desired to be 1.0 wt %–3.5 wt %. If the quantity of silicon is less than about 1.0 wt %, the precipitation and the diameter of carbon or graphite will be uneven, causing insufficient strength as a tool. On the other hand, if the quantity of silicon is more than about 3.5 wt %, sintering may be insufficient and the strength will be lower because the ferrite phase, which composes the main portion of said bond metal, may be hardened.

According to the invention, the tool can be obtained by bonding the iron-base alloy powder and the abrasive grain with powder sintering and so on. The diameter of the alloy powder before sintering as to the bonding is preferable to be 63 μm or less. If the diameter is more than 63 μm, the dispersion of the abrasive grain may become non uniform, causing lower grinding or finishing performance as a tool.

Suitable materials for the invention can be produced by a quenching method such as atomizing. This is a method for obtaining required powder with the proper cooling speed with the diameter of powder grains adjusted according to atomizing conditions with this method the size of the carbon or graphite precipitates can be controlled to the extent according to the invention by adjusting the cooling speed.

As a method of manufacturing the tool according to the invention, for example, there is a method performed by sufficiently sintering the mixture of the above-mentioned iron-base alloy powder whose grain diameter is 63 μm or less and the diamond powder which is used as the abrasive grains, into reducing or inert atmosphere. In this method, the abrasive grains of the diamond powder are dispersed uniformly in the above-mentioned iron-base alloy. Thus, the metal-bonded diamond tool which has enough bonding strength for the abrasive grains of the diamond powder can be produced easily. CBN as well as the diamond powder can be used as the abrasive grains. In this case, the CBN can be suitable for dry grinding because of its heat-resistance.

Sintering should be carried out in deoxidizing or inert atmosphere at 1000° C.–1180° C. If the sintering temperature is lower than 1000° C., it requires too long a time for the dissolution of silicon and carbon into the iron to obtain the bonding strength for the abrasive grains. On the other hand, if the sintering temperature excesses more than 1180° C., the enough bonding strength cannot be obtained due to generate the liquid phase.

The use of hot pressing enables the sintering to be performed at a temperature (850° C. or more) lower than the temperature of pressureless sintering, giving little overreaction. Moreover, as the size of the tool is not changed by contraction or expansion during sintering, the tool has the advantage that truing and dressing of the tool are omitted or remarkably simplified. When sintering is carried out, the bonding to the hub flange is performed at the same time.

If the pressure at hot pressing is lower than 50 kg/cm$^2$, it is insufficient to accelerate mutual diffusion and molding for preferable shape cannot be performed. Therefore, the pressure is desired to be higher than 50 kg/cm$^2$. If the sintering temperature is lower than 850° C., it requires too long time for the dissolution of silicon and carbon into the iron to obtain sufficient bonding strength for the abrasive grain phase. On the other hand, if the sintering temperature is higher than 1180° C., a liquid phase occurs and an overreaction may occur, causing insufficient bonding strength for the abrasive sintered product.

In order to operate the metal-bonded tool according to the invention with high efficiency and high accuracy during grinding, the hub flange should be made up of a material whose logarithmic decrement δ is 0.005 or more. As the material whose logarithmic decrement δ is 0.005 or more can absorb the micro vibration during grinding, a ground face which has higher accuracy can be obtained.

Additional methods of the invention include: bonding of the hub flange as a base metal portion when the hot pressing of the bond and the abrasive grain is carried out; and forming the hub flange with iron powder, Fe-Si powder and so on which has no abrasive grain when the hot pressing is carried out. By performing this integrated forming, the advantage of the hot pressing (truing and dressing of the tool are omitted or remarkably simplified) can be used.

The iron powder used in the invention may include unavoidable impurities such as silicon, manganese, aluminium, carbon or graphite and magnesium. Moreover, nickel or cobalt can be added as an accelerator for sintering. The interface bonding strength between the abrasive grain and the bond can be improved by a coating of nickel, copper or cobalt on the surface of the abrasive grain to be bonded. However, if the content of the additive in the bond which is composed of at least one of nickel, copper or cobalt is more than 10 wt %, the strength as the bonding material and the self-lubrication performance will be lower. Therefore, it is preferable that the extent is to within this 10 wt %.

As mentioned above, said carbon or graphite can be dispersed finely and uniformly in the iron-base alloy which is obtained by atomizing, however, this fine dispersion is difficult when ordinary iron powder is used. For example, if a large amount of graphite or carbon powder is mixed as the raw material powder into iron during sintering, cementite will precipitate in the bond. As a result, the formability and the bonding strength of the sintering product make worse. On the other hand, when the sintering carried out at low temperature, cementites do not precipitate, but the sintering are porous and carbon or graphite is retained non-uniformly. As a result, the bonding strength for the abrasives reduces. As the method for suppressing the cementite precipitation, the adding of a graphite stabilization element such as silicon, can be considered. However, heating at high temperatures which is about 1200° C. or more will be needed in order to diffuse and solute the silicon into the iron. As a result, the metal structure of the bond coarsen, causing not only lower strength of the bond but also overreaction between the bond and the diamond abrasives, etc., and graphitization of the diamond, resulting in lower grinding ability of the abrasive grain.

In case of using iron powder as a raw material, the metal-bonded tool can be obtained by using Fe-Si alloy powder containing 10 wt %–15 wt % silicon and carbon and graphite, mixing them in such a way that the relation;

$$2.5 \leqq B \leqq 4.5$$

$$3.5 \leqq B + A/3 \leqq 5$$

can be satisfied where the quantity of silicon is A wt % and the quantity of carbon or graphite is B wt % in the iron-base alloy to be the bond, and sintering.

By using the Fe-Si alloy powder as a raw material, the main composition of the bond will be easily occured to stabilize the $\alpha$ phase of iron, the sintering between iron powder will be accerated to raise the density ratio, and both the strength of the bond and the bonding strength for the abrasive can be improved.

An average grain diameter of the iron powder forming the main component of the bond is desirably less than $\frac{1}{3}$ of the average diameter of the abrasive grains. If the average grain diameter of the iron powder exceeds that value, it is impossible to disperse the iron powder evenly near the surface of the abrasive grains, and contact areas between abrasive grains themselves increase. As a result, the formability deteriorates and the abrasive grains drop cut during grinding.

The quantity of silicon in the Fe-Si alloy powder should be 10 wt %–15 wt % and the average diameter of silicon is preferably one third or less of the iron poweder. If the content of silicon is lower than 10 wt %, the density difference to the iron powder will be small and the driving force for Si-diffusion will not be sufficient. If the content of silicon is higher than 50 wt % , the mixing ratio to the iron powder will be small and it will be impossible to disperse Fe-Si powder uniformly on the surface of the iron powders. Moreover, if the average diameter is larger than $\frac{1}{3}$ of iron powder, it will be impossible to disperse Fe-Si powder uniformly on the surface as mentioned above, which causes the difficulty for obtaining uniformly dispersed bonding material. Therefore, it is desirable that this range be maintained.

The invention is described in greater detail hereafter according to embodiments.

EMBODIMENTS 1–4

After sufficiently mixing the alloy-base powder obtained by atomizing in which 5 μm or less carbon or graphite was dispersed uniformly and the blocky-shaped abrasive grain of diamond powder (average diameter is 35 μm), hot pressing was carried out 200 kg/cm$^2$ under a vacuum condition using metallic molds with 80 mm and 15 mm inside diameters. In this case, the iron-base alloy powder had the composition, the grain diameter of iron-base alloy powder, and mixing ratio as shown in the Table 1 related to Embodiments 1–4. Then, the heating, with a heating rate of 600° C. per hour, was carried out to 900° C. Then the pressure was raised under 300 kg/cm$^2$ to sinter for 30 minutes. Then finishing was done to make straight type grinding wheel and cup type grinding wheels. The temperature of this process was approximately 200° C. lower than the temperature of pressureless sintering, and any deterioration of diamond due to the reaction with iron has not been generated.

COMPARATIVE EXAMPLES 1–3

As Comparative Examples, casting into the alloy composition the same as the Embodiments shown in the Table 1 was carried out, and then pulverized turnings as the Embodiments of the alloy composition by a ball mill or stamping as the bond, in order to make straight grinding wheels and cup grinding wheels, sintering was performed in the same process. The graphite diameter of this alloy at casting was 20 μm–60 μm.

TABLE 1

| | | ALLOY COMPOSITION (wt %) | | | MIXING RATIO (wt %) | | DIAMETER OF IRON-BASE ALLOY POWDER (μm) | DIAMETER of GRAPHITE IN IRON-BASE ALLOY POWDER (μm) | POWDER PRODUCING METHOD |
|---|---|---|---|---|---|---|---|---|---|
| | | C | Si | Fe | IRON-BASE ALLOY POWDER | DIAMOND ABRASIVE GRAIN | | | |
| EMBODIMENTS | 1 | 3.3 | 2.0 | Bal | 85 | 15 | 44 OR LESS | 5 OR LESS | ATOMIZING |
| | 2 | 4.2 | — | Bal | 80 | 20 | 63 OR LESS | 5 OR LESS | ATOMIZING |
| | 3 | 3.8 | 1.8 | Bal | 90 | 10 | 53 OR LESS | 5 OR LESS | ATOMIZING |
| | 4 | 3.8 | — | Bal | 90 | 10 | 53 OR LESS | 5 OR LESS | ATOMIZING |
| COMPARATIVE EXAMPLES | 1 | 3.3 | 2.0 | Bal | 85 | 15 | 44 OR LESS | 20 OR OVER | MILLING |
| | 2 | 4.2 | — | Bal | 80 | 20 | 63 OR LESS | 20 OR OVER | MILLING |
| | 3 | 3.8 | 1.8 | Bal | 90 | 10 | 53 OR LESS | 20 OR OVER | MILLING |

Using the tools thus obtained in Embodiments 1–4 and Comparative Examples, grinding $Si_3N_4$ whose Vickers hardness is 1700 was performed under the conditions as shown in the Table 2.

TABLE 2

| GRINDING CONDITIONS | | | |
|---|---|---|---|
| GRINDING WHEEL | OUTER DIAMETER 80 mm, WIDTH 10 mm (STRAIGHT TYPE) | | |
| ROTATION SPEED | 3000 rpm | | |
| SENDING SPEED | 5 mm/min | | |
| GRINDING WIDTH | 10 mm | | |
| INFEED | 0.05 mm | EMBODIMENTS 1, 2 | COMPARATIVE EXAMPLES 1, 2 |
| | 0.25 mm | EMBODIMENTS 3, 4 | COMPARATIVE EXAMPLE 3 |

The grinding test results obtained are shown in Table 3. Grinding finish in Table 3 shows the data of the surface roughness of $Si_3N_4$ to be ground. The surface conditions of the grinding wheels were observed under a stereomicroscope. The results of evaluation was described by o (good) and x (not good). Mark "o" describes that the surface condition is good, and "x" describes that the surface condition is not good, for example, cracks partly were observed.

TABLE 3

| RESULTS OF GRINDING TEST | | GRINDING FINISH (μm) | SURFACE CONDITION OF GRINDING WHEEL |
|---|---|---|---|
| EMBODIMENTS | 1 | ±0.17 | o |
| | 2 | ±0.24 | o |
| | 3 | ±0.23 | o |
| | 4 | ±0.19 | o |
| COMPARATIVE EXAMPLES | 1 | ±2.2 | x |
| | 2 | ±3.4 | x |
| | 3 | ±2.4 | x |

Next, a lapping test using a lap machine was performed by grinding $Si_3N_4$ whose Vickers hardness is 1700, using the cup diamond grinding wheel under the conditions as shown in Table 4.

TABLE 4

| LAPPING CONDITIONS | |
|---|---|
| GRINDING WHEEL | OUTER DIAMETER 15 mm, THICKNESS 2 mm (CUP TYPE) |
| ROTATION SPEED OF BOARD | 180 rpm |
| PRESSURE | 3 kg/cm$^2$ |
| LAPPING DISTANCE | 2160 m |

The lapping test results obtained are shown in Table 5. Lapping finish in Table 5 shows the data of the surface roughness of $Si_3N_4$ to be ground. The surface conditions of the grinding wheels were observed under a stereomicroscope. The evaluation was perfomed in the same way as Table 3.

TABLE 5

| RESULTS OF LAPPING TEST | | LAPPING FINISH (μm) | SURFACE CONDITION OF GRINDING WHEEL |
|---|---|---|---|
| EMBODIMENTS | 1 | ±0.14 | o |
| | 2 | ±0.23 | o |
| | 3 | ±0.20 | o |
| | 4 | ±0.18 | o |
| COMPARATIVE EXAMPLES | 1 | ±1.8 | x |
| | 2 | ±2.8 | x |
| | 3 | ±2.3 | x |

Next, the iron-base alloy powder obtained by atomizing according to the Embodiment 1 and the iron-base alloy powder obtained by stamping the casting material according to the Comparative Example 1 were respectively mixed with the abrasive grains of diamond powder. Then, compaction molding was performed with a compacting pressure of 8 ton/cm$^2$. After sintering in hydrogen gas atmosphere at 1100° C., finishing was performed to make straight type diamond grinding wheels. Using these grinding wheels, the grinding test under the same conditions as Table 2 was performed, and results of the test are shown in Table 6. The evaluation of the surface conditions was carried out in the same way as Table 3.

TABLE 6

| RESULTS OF GRINDING TEST | GRINDING FINISH (μm) | CONDITION OF GRINDING WHEEL |
|---|---|---|
| EMBODIMENT 1 | ±0.20 | o |
| COMPARATIVE EXAMPLE 1 | ±3.1 | x |

EMBODIMENTS 5–8.

After sufficiently mixing the alloy powder obtained by atomizing in which 5 μm or less graphite was dispersed evenly and the blocky-shaped CBN abrasive grain (average diameter is 35 μm), 200 kg/cm$^2$ pressing was carried out by hot pressing under a vacuum condition using metallic molds with 80 mm and 15 mm inside diameters. In this case, the iron-base alloy powder had the composition, the grain diameter or iron-base alloy powder, and mixing ratio as shown in Table 7 related to Embodiments 5–8. Then, heating at a heating rate of 600° C. per hour is carried out to reach 900° C. Then the pressure was raised to 300 kg/cm$^2$ to sinter for 30 minutes, and then finishing was done to make straight type CBN grinding wheels and cup type CBN grinding wheels.

COMPARATIVE EXAMPLES 4–8.

Comparative Examples 4–8 are casted by the same composition as the Embodiments shown in Table 7. Thereafter, pulverized turnings are furthermore pulverized using the ball mill or stamping. Obtained powder is sintered and formed by the same process of Table 7. As a result, the straight CBN type and the cup type rinding wheels were obtained. The diameter of carbon or graphite were 20 μm–60 μm.

TABLE 7

| | | ALLOY COMPOSITION (wt %) C | Si | Fe | MIXING RATIO (wt %) IRON-BASE ALLOY POWDER | CBN | GRAIN DIAMETER OF IRON-BASE ALLOY POWDER (μm) | DIAMETER OF GRAPHITE IN IRON-BASE ALLOY POWDER (μm) | METHOD FOR PRODUCING POWDER |
|---|---|---|---|---|---|---|---|---|---|
| EMBODIMENTS | 5 | 3.3 | 2.0 | Bal | 75 | 25 | 44 OR LESS | 5 OR LESS | ATOMIZING |
| | 6 | 4.2 | — | Bal | 70 | 30 | 63 OR LESS | 5 OR LESS | ATOMIZING |
| | 7 | 3.8 | 1.8 | Bal | 80 | 20 | 53 OR LESS | 5 OR LESS | ATOMIZING |
| | 8 | 3.8 | — | Bal | 80 | 20 | 53 OR LESS | 5 OR LESS | ATOMIZING |
| COMPARATIVE EXAMPLES | 4 | 3.3 | 2.0 | Bal | 75 | 25 | 44 OR LESS | 20 OR OVER | MILLING |
| | 5 | 4.2 | — | Bal | 70 | 30 | 63 OR LESS | 20 OR OVER | MILLING |
| | 6 | 3.8 | 1.8 | Bal | 80 | 20 | 53 OR LESS | 20 OR OVER | MILLING |
| | 7 | 2.1 | — | Bal | 80 | 20 | 63 OR LESS | 5 OR LESS | ATOMIZING |
| | 8 | 6.2 | — | Bal | 80 | 20 | 63 OR LESS | 5 OR LESS | ATOMIZING |

The grinding test of these Embodiments 5–8 and Comparative Examples 4–8 was performed by grinding $Si_3N_4$ whose Vickers hardness is 1700 using the straight type CBN abrasive grain under the conditions as shown in Table 2, similar to Embodiments 1–4. The 0.05 mm cutting depth for Embodiments 5, 6 and Comparative Examples 4, 5, and the 0.25 mm infeed depth for Embodiments 7, 8 and Comparative Example 6 were used. The results of the grinding test was shown in Table 8. The grinding finish in Table 8 shows the data of the surface roughness of $Si_3N_4$ and carbon or graphite steel (S45C) to be ground. The surface condition of the grinding wheel was observed under a stereomicroscope.

TABLE 8

| | | RESULTS OF GRINDING TEST MATERIALS TO BE GRINDED | | | |
|---|---|---|---|---|---|
| | | Si3N4 | | CARBON STEEL(S45C) | |
| | | GRINDING FINISH (μm) | SURFACE CONDITION OF GRINDING WHEEL | GRINDING FINISH (μm) | SURFACE CONDITIONS OF GRINDING WHEEL |
| EMBODIMENTS | 5 | ±0.27 | o | ±0.62 | o |
| | 6 | ±0.41 | o | ±1.15 | o |
| | 7 | ±0.39 | o | ±0.94 | o |
| | 8 | ±0.34 | o | ±0.82 | o |
| COMPARATIVE EXAMPLES | 4 | ±4.1 | x | ±16.4 | x |
| | 5 | ±8.7 | x | ±21.3 | x |
| | 6 | ±4.7 | x | ±17.8 | x |
| | 7 | ±1.6 | x | ±3.7 | x |
| | 8 | ±1.8 | x | ±6.3 | x |

Next, a lapping test using a lap machine was performed by grinding $Si_3N_4$ whose Vickers hardness is 1700 and carbon or graphite steel (S45C), using the cup type diamond grinding wheel under the conditions as shown in Table 4. The results of the lapping test was shown in Table 9. The lapping finish in Table 9, or the surface conditions of $Si_3N_4$ to be lapped, was observed under a stereomicroscope.

TABLE 9

| | | RESULTS OF LAPPING TEST MATERIALS TO BE LAPPED | | | |
|---|---|---|---|---|---|
| | | Si3N4 | | CARBON STEEL(S45C) | |
| | | LAPPING FINISH (μm) | SURFACE CONDITION OF GRINDING WHEEL | LAPPING FINISH (μm) | SURFACE CONDITION OF GRINDING WHEEL |
| EMBODIMENTS | 5 | ±0.26 | o | ±0.53 | o |
| | 6 | ±0.32 | o | ±1.10 | o |
| | 7 | ±0.29 | o | ±0.96 | o |
| | 8 | ±0.27 | o | ±0.84 | o |
| COMPARATIVE EXAMPLES | 4 | ±3.9 | x | ±14.9 | x |
| | 5 | ±6.2 | x | ±20.1 | x |
| | 6 | ±5.2 | x | ±18.5 | x |
| | 7 | ±1.3 | x | ±3.3 | x |
| | 8 | ±1.6 | x | ±4.1 | x |

Next, the iron-base alloy powder obtained by atomizing according to the Embodiment 5 and the iron-base alloy powder obtained by turning the casting material according to the Comparative Example 4 were respectively mixed with the abrasive grain of CBN powder. Then, compression molding was performed with a compression pressure of 8 ton/cm$^2$. After sintering in hydrogen gas atmosphere at 1100° C., finishing was performed to make straight type diamond grinding wheels.

Using these grinding wheels, the grinding test under the same conditions as Table 2 was performed. Table 10 shows the results.

TABLE 10

| | RESULTS OF GRINDING TEST MATERIALS TO BE ground | | | |
|---|---|---|---|---|
| | $Si_3N_4$ | | CARBON STEEL (S45C) | |
| | GRINDING FINISH (μm) | SURFACE CONDITION OF GRINDING WHEEL | GRINDING FINISH (μm) | SURFACE CONDITION OF GRINDING |
| EMBODIMENT 5 | ±0.42 | o | ±1.22 | o |
| EMBODIMENT 6 | ±5.8 | x | ±16.9 | x |

EMBODIMENTS 9–12

Embodiments 9, 10, 11 and 12 shown in Table 11 are respectively the replacements of Embodiments 1, 2, 3 and 4 shown in Table 1. After sintering, similarly to the Embodiments 1, 2, 3 and 4, finishing was done to make straight type diamond grinding wheels and cup type diamond grinding wheels.

TABLE 11

| | | ALLOY COMPOSITION (wt %) | | | MIXING RATIO (wt %) | | | GRAIN DIAMETER OF IRON-BASE ALLOY POWDER (μm) | DIAMETER OF GRAPHITE IN IRON-BASE ALLOY POWDER (μm) | METHOD FOR PRODUCING POWDER |
|---|---|---|---|---|---|---|---|---|---|---|
| | | C | Si | Fe | IRON-BASE ALLOY POWDER | DIAMOND | CBN | | | |
| EMBODIMENTS | 9 | 3.3 | 2.0 | Bal | 85 | 9 | 6 | 44 OR LESS | 5 OR LESS | ATOMIZING |
| | 10 | 4.2 | — | Bal | 80 | 7 | 13 | 63 OR LESS | 5 OR LESS | ATOMIZING |
| | 11 | 3.8 | 1.8 | Bal | 90 | 5 | 5 | 53 OR LESS | 5 OR LESS | ATOMIZING |

TABLE 11-continued

| | ALLOY COMPOSITION (wt %) | | | MIXING RATIO (wt %) | | | GRAIN DIAMETER OF IRON-BASE ALLOY POWDER (μm) | DIAMETER OF GRAPHITE IN IRON-BASE ALLOY POWDER (μm) | METHOD FOR PRODUCING POWDER |
|---|---|---|---|---|---|---|---|---|---|
| | C | Si | Fe | IRON-BASE ALLOY POWDER | DIAMOND | CBN | | | |
| 12 | 3.8 | — | Bal | 90 | 7 | 3 | 53 OR LESS | 5 OR LESS | ATOMIZING |

The grinding test was performed using the straight type diamond grinding wheels by grinding $Si_3N_4$ whose Vickers hardness is 1700 under the conditions as shown in Table 2. The grinding test results obtained are shown in Table 12. Grinding finish in Table 12 shows the data of the surface roughness of $Si_3N_4$ to be ground. The surface conditions of the grinding wheels were observed under the stereomicroscope. The lapping test using a lapping machine was performed by lapping $Si_3N_4$ whose Vickers hardness is 1700, using the cup type diamond grinding wheels under the conditions as shown in Table 4.

TABLE 12

| | | RESULT OF LAPPING TEST | |
|---|---|---|---|
| | | LAPPING FINISH (μm) | SURFACE CONDITION OF GRINDING WHEEL |
| EMBODIMENTS | 9 | ±0.23 | o |
| | 10 | ±0.35 | o |
| | 11 | ±0.29 | o |
| | 12 | ±0.24 | o |

The lapping test results obtained are shown in Table 13. Lapping finish in Table 13 shows the data of the surface roughness of $Si_3N_4$ to be ground. The surface conditions of the grinding wheels were observed under a stereomicroscope.

TABLE 13

| | | RESULTS OF LAPPING TEST | |
|---|---|---|---|
| | | LAPPING FINISH (μm) | SURFACE CONDITION OF GRINDING WHEEL |
| EMBODIMENTS | 9 | ±0.19 | o |
| | 10 | ±0.27 | o |
| | 11 | ±0.24 | o |
| | 12 | ±0.22 | o |

EMBODIMENTS 13–16

Embodiments 13, 14, 15 and 16 shown in Table 14 are respectively Embodiments 1, 2, 3 and 4 which were coated with nickel, copper and cobalt. After sintering, similarly to the Embodiments 1, 2, 3 and 4, finishing was done to make straight type diamond grinding wheels and cup type diamond grinding wheels.

The grinding test was performed using the straight type diamond grinding wheels by grinding $Si_3N_4$ whose Vickers hardness is 1700 under the conditions as shown in Table 2.

TABLE 15

| | | RESULTS OF GRINDING TEST | |
|---|---|---|---|
| | | groundING FINISH (μm) | SURFACE CONDITION OF GRINDING WHEEL |
| EMBODIMENTS | 1 | ±0.14 | o |
| | 2 | ±0.22 | 0 |
| | 3 | ±0.20 | o |
| | 4 | ±0.17 | o |

Next, a lapping test using a lapping machine was performed by grinding $Si_3N_4$ whose Vickers hardness is 1700, using the cup type diamond grinding wheels under the conditions as shown in Table 4. The lapping test results obtained are shown in Table 16. Lapping finish in the Table 16 shows the data of the surface roughness of $Si_3N_4$ to be ground. The surface conditions of the grinding wheels were observed under a stereomicroscope.

TABLE 16

| | | RESULTS OF LAPPING TEST | |
|---|---|---|---|
| | | LAPPING FINISH (μm) | SURFACE CONDITION OF GRINDING WHEEL |
| EMBODIMENTS | 1 | ±0.11 | o |
| | 2 | ±0.20 | o |
| | 3 | ±0.17 | o |
| | 4 | ±0.15 | o |

EMBODIMENTS 17–24

After sufficiently mixing the alloy powder, the blocky-shaped abrasive grain of diamond powder and the CBN abrasive grain, hot pressing was carried out at 200 kg/cm$^2$ under a vacuum condition ($1\times10^{-4}$ Torr) using a metallic mold with a 150 mm inside diameter. In this case, the iron-base alloy powder had the compositions shown in Tables 17 and 18, the mixing ratio of the diamond abrasive grain was #170/200 and the CBN abrasive grain was #170/200, the carbon or graphite diameter being 1/10 or less of the abrasive grain diame-

TABLE 14

| | | ALLOY COMPOSITION (wt %) | | | | | | MIXING RATIO (wt %) | | GRAIN DIAMETER OF IRON-BASE ALLOY POWDER (μm) | DIAMETER OF CARBON IN IRON-BASE ALLOY POWDER (μm) | METHOD OF PRODUCING POWDER |
|---|---|---|---|---|---|---|---|---|---|---|---|---|
| | | C | Si | Ni | Cu | Co | Fe | IRON-BASE ALLOY POWDER | *DIAMOND ABRASIVE GRAIN | | | |
| EMBODIMENTS | 13 | 3.3 | 2.0 | — | <5.0 | — | Bal | 85 | 15 | 44 OR LESS | 5 OR LESS | ATOMIZING |
| | 14 | 4.2 | — | <7.0 | — | — | Bal | 80 | 20 | 63 OR LESS | 5 OR LESS | ATOMIZING |
| | 15 | 3.8 | 1.8 | <3.0 | — | — | Bal | 90 | 10 | 53 OR LESS | 5 OR LESS | ATOMIZING |
| | 16 | 3.8 | — | — | — | <3.0 | Bal | 90 | 10 | 53 OR LESS | 5 OR LESS | ATOMIZING |

*The diamond abrasive grain was coated with Ni, Cu, and Co.
The coating quantity was reduced to the alloy composition.

ter, the 90% or more carbon or graphite dispersion, and 60 kg/mm$^2$ or more bending strength. Then, heating with a heating rate of 600° C. per hour was carried out to reach 600° C., and the pressure was raised under 400 kg/cm$^2$ at 900° C. to sinter for 30 minutes. The tool obtained was finished to make straight type grinding wheels and CBN type grinding wheels. The temperature of this process was approximately 200° C. lower than the temperature of pressureless sintering, and no deterioration of diamond due to the reaction with iron occured.

TABLE 17

| | | ALLOY COMPOSITION (Wt %) | | | MIXING RATIO (Wt %) | | CARBON DIAMETER (CARBON DIAMETER/ ABRASIVE GRAIN DIAMETER) | DISTRIBUTION RATIO | BREAK RESISTANT STRENGTH OF IRON ALLOY | METHOD FOR PRODUCING TOOL |
|---|---|---|---|---|---|---|---|---|---|---|
| | | C | Si | Fe | IRON-BASE ALLOY POWDER | DIAMOND ABRASIVE GRAIN | (μm) | (%) | (kg/mm$^2$) | |
| EMBODIMENTS | 17 | 3.3 | 2.0 | Bal | 84 | 16 | 6/88 | 93 | 70 | HOT PRESSING |
| | 18 | 4.5 | 1.0 | Bal | 78 | 22 | 7/88 | 92 | 80 | HOT PRESSING |
| | 19 | 2.5 | 3.4 | Bal | 80 | 20 | 2/88 | 90 | 75 | HOT PRESSING |
| | 20 | 3.5 | 2.8 | Bal | 75 | 25 | 3/88 | 96 | 92 | HOT PRESSING |
| COMPARATIVE EXAMPLES | 9 | 3.3 | 1.8 | Bal | 84 | 16 | 47/88 | 65 | 45 | SINTERING AT PRESSURELESS SINTERING |
| | 10 | 2.5 | 3.8 | Bal | 80 | 20 | 30/88 | 60 | 37 | HOT PRESSING |
| | 11 | 5.5 | 1.3 | Bal | 78 | 22 | 52/88 | 50 | 33 | HOT PRESSING |

TABLE 18

| | | ALLOY COMPOSITION (Wt %) | | | MIXING RATIO (Wt %) | | CARBON DIAMETER (CARBON DIAMETER/ ABRASIVE GRAIN DIAMETER) | DISTRIBUTION RATIO | BREAK RESISTANT STRENGTH OF IRON ALLOY | METHOD FOR PRODUCING TOOL |
|---|---|---|---|---|---|---|---|---|---|---|
| | | C | Si | Fe | IRON-BASE ALLOY POWDER | CBN | (μm) | (%) | (kg/mm$^2$) | |
| EMBODIMENTS | 21 | 3.3 | 2.0 | Bal | 82 | 18 | 6/88 | 93 | 70 | HOT PRESSING |
| | 22 | 4.5 | 1.0 | Bal | 76 | 24 | 7/88 | 92 | 80 | HOT PRESSING |
| | 23 | 2.5 | 3.4 | Bal | 78 | 22 | 2/88 | 90 | 75 | HOT PRESSING |
| | 24 | 3.5 | 2.8 | Bal | 73 | 27 | 3/88 | 96 | 92 | HOT PRESSING |
| COMPARATIVE EXAMPLES | 12 | 3.3 | 1.8 | Bal | 82 | 18 | 47/88 | 65 | 45 | SINTERING AT PRESSURELESS SINTERING |
| | 13 | 2.5 | 3.8 | Bal | 78 | 22 | 30/88 | 60 | 37 | HOT PRESSING |
| | 14 | 5.5 | 1.3 | Bal | 76 | 24 | 52/88 | 50 | 33 | HOT PRESSING |

COMPARATIVE EXAMPLES 9–14

After the iron-base alloy powder having the alloy composition and the iron alloy shown in Tables 1 and 2, the mixing ratio of the diamond abrasive grain #170/200 (88 μm average diameter), the carbon or graphite diameter being $\frac{1}{3}$–$\frac{1}{2}$ or more of the abrasive grain diameter, with 50–65% or more carbon or graphite dispersion, and 30–45 kg/mm$^2$ or more bending strength was performed, compaction molding was carried out with 8 ton/cm$^2$ compacting pressure and with the same process as the Embodiments. Then the pressureless sintering was carried out in hydrogen atmosphere at 1100° C. for a long time to make straight type grinding wheels. Under the conditions shown in Table 13, grinding $Si_3N_4$ whose Vickers hardness is 1700 using the diamond abrasive grain, and grinding a hard metal P20 using the CBN type grinding wheels was carried out.

TABLE 19

| GRINDING CONDITIONS | | | |
|---|---|---|---|
| GRINDING SPEED | V = 2500 m/min | SENDING SPEED | f = 15 m/min |
| GRINDING WIDTH | W = 10 mm | GRINDING QUANTITY | R = 3000 mm$^3$/mm |
| INFEED DEPTH | 0.5 mm ($Si_3N_4$), 0.1 mm (HARD METAL) | | |
| GRINDING PROCESS | UP/DOWN GRINDING EACH OTHER | | |

TABLE 19-continued

| GRINDING CONDITIONS | |
|---|---|
| GRINDING AGENT | WATER SOLUBLE GRINDING AGENT 60 l/min |
| GRINDING WHEEL | OUTER DIAMETER 150 mm, WIDTH 10 mm, GRAIN SIZE #170/200 |

The results thus obtained are shown in Tables 20, 21. The density in Tables indicates the density as a tool after sintering. The grinding force in the normal direction of the normal line are measured values. The grinding ratio is given by the ratio of the quantity of removed materials to be ground to the quantity of grinding wheel wear. The roughness of the work pieces indicates the data of $Si_3N_4$ and hard metal roughness. The surface conditions of the materials to be ground were observed under a stereomicroscope for lacks or attachments on the surface.

were shaped. Those for comparison were that the conditions underlined in Table 22 were out of the extent according to the invention.

Next, a bending test was carried out on the above-mentioned samples a, b, c, d, e, f, g and h, and i, j, k, l, m, n and o to obtain bending strength and elastic moduli. The results were shown in Table 22. These results obviously reveal that the materials composing the abrasive grain phase according to the invention do not react excessively on the diamond grains or the CBN abrasive grains, and that the shaping is done with high density and both the bending strength and the bending elastic modulus are large.

EMBODIMENT 26

Compositions c, d, and g shown in Table 22 were uniformly mixed and then shaping was carried out to produce pressed powder under a pressure of 4.2 ton/cm$^3$. After that, sintering was performed in a meth-

TABLE 20

| | | GRINDSTONE: DIAMOND GRINDSTONE, GRINDED MATERIAL: $Si_3N_4$ | | | | | | |
|---|---|---|---|---|---|---|---|---|
| | | GRINDING FORCE IN NORMAL LINE DIRECTION | | GRINDED | GRINDED MATERIAL | | GRINDING SURFACE ROUGHNESS | SINTERING DENSITY RATIO |
| | | Up | Down | RATIO | LACKS | ATTACHMENTS | Ra (μm) | (%) |
| EMBODIMENTS | 17 | 42.7 | 40.5 | 408 | NOT EXIST | NOT EXIST | 1.42 | 93 |
| | 18 | 39.4 | 37.5 | 470 | NOT EXIST | NOT EXIST | 1.68 | 95 |
| | 19 | 40.3 | 39.0 | 445 | NOT EXIST | NOT EXIST | 1.54 | 91 |
| | 20 | 36.4 | 33.0 | 485 | NOT EXIST | NOT EXIST | 1.73 | 97 |
| COMPARATIVE EXAMPLES | 9 | 95.2 | 94.8 | 63 | EXIST | FEW | 18.6 | 64 |
| | 10 | 89.5 | 89.2 | 107 | EXIST | FEW | 16.4 | 81 |
| | 11 | 112.2 | 111.8 | 87 | EXIST | MANY | 24.7 | 76 |

TABLE 21

| | | GRINDSTONE: CBN GRINDSTONE GRINDED MATERIAL: HARD METAL | | | | | | |
|---|---|---|---|---|---|---|---|---|
| | | GRINDING FORCE IN NORMAL LINE DIRECTION | | GRINDING | GRINDED MATERIAL | | GRINDING SURFACE ROUGHNESS | SINTERING DENSITY RATIO |
| | | Up | Down | RATIO | LACKS | ATTACHMENTS | Ra (μm) | (%) |
| EMBODIMENTS | 21 | 10.6 | 10.1 | 1405 | NOT EXIST | NOT EXIST | 1.72 | 94 |
| | 22 | 9.8 | 8.9 | 1530 | NOT EXIST | NOT EXIST | 1.92 | 95 |
| | 23 | 10.1 | 9.7 | 1485 | NOT EXIST | NOT EXIST | 1.88 | 92 |
| | 24 | 9.1 | 8.4 | 1640 | NOT EXIST | NOT EXIST | 1.96 | 96 |
| COMPARATIVE EXAMPLES | 12 | 52.7 | 51.4 | 215 | EXIST | FEW | 19.8 | 62 |
| | 13 | 48.2 | 48.0 | 373 | EXIST | FEW | 18.3 | 83 |
| | 14 | 59.3 | 58.9 | 294 | EXIST | MANY | 28.4 | 72 |

EMBODIMENT 25

Raw materials were graphite powder having an average grain diameter of 12 μm; Fe-Si alloy powder having an average grain diameter of 3 μm and having 43 wt % and 69 wt % silicon contents; Fe-Si alloy powder having an average grain diameter of 8 μm and having 16 wt % silicon contents; Fe-Si alloy powder having diameters of 8, 10, and 20 μm and having 21 wt % silicon content; Fe-Si alloy powder having average grain diameters of 10 μm and 30 μm; diamond abrasive grains having average grain diameters of 30 μm and 100 μm (IMS, To-mei Diamond Ko-gyo Kabushiki-kaisha); and cubic silicon nitride abrasive grains (ABN; De Beers Corporation).

The powder of these raw materials was uniformly mixed to the composition as shown in Table 22, and then pressed into powder under 4.2 ton/cm$^3$ pressure. After that, sintering was performed in the methane conversion gas atmosphere at the temperatures shown in Table 22, and the length of 100 mm and width of 10 mm samples (a, b, c, d, e, f, g and h) for bending tests, and samples for comparison tests (i, j, k, l, m, n and o)

ane conversion gas atmosphere at the temperatures shown in Table 22 to shape abrasive grain phase rings of outer diameter of 150 mm, width of 10 mm and thickness of 5 mm. On the other hand, as a comparison, k and l were shaped into the same rings as mentioned above in size under the conditions shown in Table 22. These rings were bonded to the hub flange of 18Cr-8Ni-Fe stainless steel to make diamond grinding wheels and CBN grinding wheels. A grinding test was performed using these grinding wheels in the grinding conditions according to Table 23. The results are shown in Table 24. The grinding force in the normal direction indicates the data measured by a tool dynamometer. The grinding ratio is given by the ratio of the quantity of removed materials to be ground to the quantity of grinding wheel wear. The roughness of the ground surface indicates the data of the work pieces's ($Si_3N_4$ and hard metal) roughness. This Table obviously reveals that the metal-bonded tool according to the invention, compared to the Comparative Examples, has lower grinding force and a higher grinding ratio. Moreover, the surface roughness of the work pieces is fine, which shows an advanced grinding property.

EMBODIMENT 27

Compositions a and b shown in Table 22 were evenly mixed and then shaping was carried out to produce pressed powder under a pressure of 4.2 ton/cm$^3$. After that, sintering was performed in a methane conversion gas atmosphere at the temperatures shown in Table 22 to shape abrasive grain phase rings of outer diameter of 150 mm, width of 10 mm and thickness of 5 mm. These rings were bonded to the two kinds of the hub flange; 12Cr-3Al-Fe stainless steel having large vibration damping capacity and 18Cr-8Ni-Fe stainless steel having small vibration damping capacity; to make four kinds of diamond tools.

The grinding test was performed using these tools in the grinding conditions I according to Table 23. The resulting grinding force (average and deviation) and the roughness of the work pieces to be ground are shown in Table 25. This Table obviously reveals that the diamond tool which uses 12Cr-3Al-Fe stainless steel having large vibration damping capacity changes little in grinding force, enabling stable grinding. Moreover, the surface roughness of the work pieces to be ground is fine. This shows an advanced diamond tool.

TABLE 22

| | | RAW MATERIAL FOR BONDS Fe—Si ALLOY POWDER | | | MIXING COMPOSITION OF BONDS (Wt %) | | | ABRASIVE GRAIN AND AVERAGE DIAMETER (μm) | | MIXING COMPOSITION OF ABRASIVE GRAIN PHASE | | SINTERING TEMPERATURE | MECHANICAL PROPERTIES OF ABRASIVE GRAIN | |
|---|---|---|---|---|---|---|---|---|---|---|---|---|---|---|
| | | Si CONTENT (Wt %) | AVERAGE GRAIN DIAMETER (μm) | AVERAGE GRAIN DIAMETER (μm) | Fe | Si | C | D: DIAMOND B:BORON NITRIDE | | BOND (Wt %) | ABRASIVE GRAIN (Wt %) | °C. | BENDING STRENGTH kg/mm$^2$ | BENDING ELASTIC kg/mm$^2$ |
| EMBODIMENTS | a | 16 | 8 | 30 | Bal | 2.1 | 3.3 | D | 100 | 84 | 16 | 1050 | 39.2 | 9900 |
| | b | 43 | 3 | 10 | Bal | 1.3 | 4.2 | D | 30 | 78 | 22 | 1050 | 46.0 | 12400 |
| | c | 21 | 8 | 30 | Bal | 3.6 | 2.4 | D | 100 | 80 | 20 | 1050 | 40.3 | 9900 |
| | d | 21 | 10 | 30 | Bal | 2.6 | 3.3 | D | 100 | 75 | 25 | 1140 | 38.1 | 9800 |
| | e | 21 | 10 | 30 | Bal | 2.6 | 3.3 | B | 100 | 82 | 18 | 1140 | 42.4 | 11000 |
| | f | 21 | 10 | 30 | Bal | 3.1 | 2.7 | D:B = 1:1 | 100 | 83 | 17 | 1140 | 41.2 | 10000 |
| | g | 21 | 10 | 30 | Bal | 1.6 | 4.2 | B | 100 | 78 | 22 | 1140 | 45.1 | 12000 |
| | h | 21 | 10 | 30 | Bal | 2.1 | 3.3 | B | 100 | 76 | 24 | 1140 | 42.7 | 11000 |
| COMPARATIVE EXAMPLES | i | 69 | 3 | 10 | Bal | 1.3 | 4.2 | D | 30 | 78 | 22 | 1140 | 27.0 | 7700 |
| | j | 21 | 20 | 30 | Bal | 3.5 | 2.7 | D | 100 | 80 | 20 | 1140 | 28.9 | 7800 |
| | k | 21 | 10 | 30 | Bal | 2.9 | 3.3 | D | 40 | 75 | 25 | 1140 | 24.1 | 7600 |
| | l | 21 | 10 | 30 | Bal | 4.8 | 3.3 | D | 100 | 82 | 18 | 1050 | 25.2 | 7600 |
| | m | 21 | 10 | 30 | Bal | 3.3 | 1.6 | D | 100 | 84 | 16 | 1050 | 23.4 | 7500 |
| | n | 16 | 8 | 30 | Bal | 2.1 | 3.3 | D | 100 | 84 | 16 | 890 | 17.9 | 7200 |
| | o | 16 | 8 | 30 | Bal | 2.1 | 3.3 | D | 100 | 84 | 16 | 1250 | 20.3 | 7400 |

TABLE 23

| | GRINDING CONDITION I | GRINDING CONDITION II |
|---|---|---|
| ground MATERIALS | SINTERING AT ORDINARY TEMPERATURE $Si_3N_4$ (H/1700) | HARD METAL P30 |
| GRINDING SPEED m/min | 2000 | 2000 |
| FEED SPEED m/min | 15 | 15 |
| GRINDING WIDTH mm | 10 | 10 |
| GRINDING QUANTITY mm$^3$/mm | 5000 | 2000 |
| INFEED DEPTH mm | 0.5 | 0.05 |
| FEED DIRECTION | UP, DOWN MUTUALLY | UP, DOWN MUTUALLY |
| GRINDING AGENT | WATER SOLUBLE GRINDING AGENT 60 l/min | MINERAL OIL |

TABLE 24

| | | ABRASIVE GRAIN PHASE | GRINDING CONDITIONS | GRINDING FORCE IN NORMAL LINE DIRECTION kg/mm$^2$ | GRINDING RATIO | SURFACE ROUGHNESS Ra OF GRINDING MACHINE TO BE GRINDED (μm) |
|---|---|---|---|---|---|---|
| EMBODIMENTS | c1 | c | I | 39.4 | 508 | 1.6 |
| | d1 | d | I | 40.2 | 570 | 1.7 |
| | g1 | g | II | 42.6 | 545 | 1.5 |
| COMPARATIVE EXAMPLES | k1 | k | I | 121 | 72 | 21.2 |
| | l1 | l | I | 116 | 33 | 19.3 |

TABLE 25

| | | ABRASIVE GRAIN PHASE | MATERIALS OF HUB FLANGE | LOGARITHTIC DECREMENT OF HUB FLANGE MATERIALS | GRINDING FORCE kg/mm$^2$ | SURFACE ROUGHNESS Ra OF GRINDING MACHINE TO BE GRINDED (μm) |
|---|---|---|---|---|---|---|
| EMBODIMENTS | a1 | a | 12Cr—3Al—Fe STAINLESS STEEL | 0.01 | 39.8 ± 2 | 0.8 |
| | b1 | b | 12Cr—3Al—Fe STAINLESS STEEL | 0.01 | 40.6 ± 2 | 0.9 |
| COMPARATIVE | a1 | a | 18Cr—8Ni—Fe STAINLESS STEEL | 0.001 | 42.4 ± 5 | 1.7 |
| EXAMPLES | b1 | b | 18Cr—8Ni—Fe STAINLESS STEEL | 0.001 | 47.3 ± 6 | 1.8 |

EMBODIMENT 28

The same raw materials as in Embodiment 25 were uniformly mixed to the composition as shown in Table 26, and then they were filled in a graphite mold. After that, hot pressing was performed (in a vacuum of $5\times10^{-4}$ Torr) for one hour under the hot pressing condition as shown in Table 26 to shape of length of 100 mm, width of 10 mm and thickness of 3 mm samples (a1, b1, c1, d1, e1, f1, g1and h1) for bending tests, and samples for comparison tests i1, j1, k1, l1, m1, n1and o1). Those for comparison were that the conditions underlined in Table 22 were out of the extent according to the invention.

Next, a bending test was carried out on the above-mentioned samples a1, b1, c1, d1, e1, f1, g1 and h1, and i1, j1, k1, l1, m1, n1 and o1 to obtain bending strength and elastic moduli. The results were shown in Table 26. These results obviously reveal that the materials composing the abrasive grain phase according to the invention do not react excessively on the diamond grains or the CBN abrasive grains, and that the forming is done with high density and both the bending strength and the bending elastic modulus are large.

EMBODIMENT 29

The compositions c1, d1, and g1 as shown in Table 26 were uniformly mixed, and then they were filled in a graphite ring mold. After that, hot pressing was performed (in a vacuum of $5\times10^{-4}$ Torr) for one hour under the hot pressing condition as shown in Table 26 to an outer diameter shape of 150 mm, width of 10 mm and thickness of 5 mm abrasive grain rings. On the other hand, as a comparison, k and l were formed into the same abrasive grain layer rings as mentioned above in size under the conditions shown in Table 26. These rings were bonded to the hub flange of 18Cr-8Ni-Fe stainless steel to make diamond grinding wheels and CBN grinding wheels. These grinding wheels were used and the results are shown in Table 28. The grinding force indicates the data measured using a tool dynamometer. The grinding ratio is given by the ratio of the quantity of removed work pieces to the quantity of grinding wheel wear. The surface roughness indicates the roughness of the surface of the work pieces ($Si_3N_4$ and hard metal). This Table obviously reveals that the metal-bonded tool according to the invention, compared to the Comparative Examples, has lower grinding force and a higher grinding ratio. Moreover, the surface roughness of the work pieces is fine, which shows an advanced grinding characteristic.

EMBODIMENT 30

The compositions a1 and bas shown in the Example 26 were uniformly mixed, and then they were filled in a graphite ring mold. After that, hot pressing was performed (in vacuum of $5\times10^{-4}$ Torr) for one hour under the hot pressing condition as shown in Table 26 to shape two abrasive grain rings of outer diameter of 150 mm, width of 10 mm and thickness of 5 mm, respectively.

These rings were bonded to the two kinds of the hub flange; 12Cr-3Al-Fe stainless steel having large vibration damping capacity and 18Cr-8Ni-Fe stainless steel having small vibration damping capacity; to make four kinds of diamond tools. A grinding test was performed using these tools in the grinding conditions I according to Table 2. The resulting grinding force (average and deviation) and the roughness of the work pieces are shown in Table 29. This Table obviously reveals that the diamond tool which uses 12Cr-3Al-Fe stainless steel having large vibration damping capacity changes little in grinding force, enabling stable grinding. Moreover, the surface roughness of the work pieces is fine. This shows an advanced diamond tool.

TABLE 26

| | RAW MATERIALS FOR BONDS Fe—Si ALLOY POWDER | | | MIXING COMPOSITION OF BONDS (Wt %) | | | ABRASIVE GRAIN AND AVERAGE DIAMETER (μm) | MIXING COMPOSITION OF ABRASIVE GRAIN PHASE | | HOT PRESSING CONDITIONS | | MECHANICAL PROPERTIES OF ABRASIVE GRAIN | |
|---|---|---|---|---|---|---|---|---|---|---|---|---|---|
| | Si CONTENT (Wt %) | AVERAGE GRAIN DIAMETER (μm) | AVERAGE GRAIN DIAMETER (μm) | Fe | Si | C | D: DIAMOND B:BORON NITRIDE | BOND (Wt %) | ABRASIVE GRAIN (Wt %) | TEMPERATURE °C. | PRESSURE kg/cm$^2$ | BENDING STRENGTH kg/mm$^2$ | BENDING ELASTIC MODULI kg/mm$^2$ |
| EMBODIMENTS | | | | | | | | | | | | | |
| a1 | 17 | 8 | 30 | Bal | 2.0 | 3.5 | D | 100 | 84 | 16 | 900 | 200 | 67 | 18000 |
| b1 | 48 | 3 | 10 | Bal | 1.4 | 4.4 | D | 30 | 78 | 22 | 1000 | 200 | 73 | 17500 |
| c1 | 26 | 8 | 30 | Bal | 3.4 | 2.6 | D | 100 | 80 | 20 | 900 | 250 | 62 | 16300 |
| d1 | 26 | 10 | 30 | Bal | 2.8 | 3.5 | D | 100 | 75 | 25 | 900 | 250 | 68 | 16500 |

TABLE 26-continued

| | RAW MATERIALS FOR BONDS Fe—Si ALLOY POWDER | | | MIXING COMPOSITION OF BONDS (Wt %) | | | ABRASIVE GRAIN AND AVERAGE DIAMETER (μm) | | MIXING COMPOSITION OF ABRASIVE GRAIN PHASE | | HOT PRESSING CONDITIONS | | MECHANICAL PROPERTIES OF ABRASIVE GRAIN | |
|---|---|---|---|---|---|---|---|---|---|---|---|---|---|---|
| | Si CONTENT (Wt %) | AVERAGE GRAIN DIAMETER (μm) | AVERAGE GRAIN DIAMETER (μm) | Fe | Si | C | D: DIAMOND B:BORON NITRIDE | | BOND (Wt %) | ABRASIVE GRAIN (Wt %) | TEMPERATURE °C. | PRESSURE kg/cm² | BENDING STRENGTH kg/mm² | BENDING ELASTIC MODULI kg/mm² |
| e1 | 26 | 10 | 30 | Bal | 2.8 | 3.5 | B | 100 | 82 | 18 | 1100 | 100 | 75 | 17300 |
| f1 | 26 | 10 | 30 | Bal | 3.4 | 2.6 | D:B = 1:1 | 100 | 83 | 17 | 1000 | 100 | 63 | 16700 |
| g1 | 26 | 10 | 30 | Bal | 1.4 | 4.4 | B | 100 | 78 | 22 | 1100 | 80 | 75 | 17100 |
| h1 | 26 | 10 | 30 | Bal | 2.0 | 3.5 | B | 100 | 76 | 24 | 1140 | 60 | 76 | 17200 |
| COMPARATIVE EXAMPLES | | | | | | | | | | | | | | |
| i1 | 71 | 3 | 10 | Bal | 1.4 | 4.4 | D | 30 | 78 | 22 | 1000 | 200 | 32 | 10200 |
| j1 | 26 | 20 | 30 | Bal | 3.4 | 2.6 | D | 100 | 80 | 20 | 900 | 250 | 27 | 9000 |
| k1 | 26 | 10 | 30 | Bal | 2.8 | 3.5 | D | 40 | 75 | 25 | 900 | 250 | 63 | 10700 |
| l1 | 26 | 10 | 30 | Bal | 4.7 | 3.5 | D | 100 | 82 | 18 | 1100 | 100 | 22 | 8300 |
| m1 | 26 | 10 | 30 | Bal | 3.4 | 1.7 | D | 100 | 84 | 16 | 1000 | 100 | 29 | 9900 |
| n1 | 17 | 8 | 30 | Bal | 2.0 | 3.5 | D | 100 | 84 | 16 | 1000 | 0 | 33 | 9200 |
| o1 | 17 | 8 | 30 | Bal | 2.0 | 3.5 | D | 100 | 84 | 16 | 1250 | 60 | 23 | 8500 |

TABLE 27

| | GRINDING CONDITION I | GRINDING CONDITION II |
|---|---|---|
| ground MATERIALS | SINTERING AT ORDINARY TEMPERATURE $Si_3N_4$ (H/1700) | HARD METAL P30 |
| GRINDING SPEED m/min | 1500 | 1500 |
| FEED SPEED m/min | 5 | 5 |
| GRINDING WIDTH mm | 10 | 10 |
| GRINDING QUANTITY mm³/mm | 3000 | 2500 |
| CUTTING DEPTH mm | 0.5 | 0.05 |
| FEED DIRECTION | UP, DOWN MUTUALLY | UP, DOWN MUTUALLY |
| GRINDING AGENT | WATER SOLUBLE GRINDING AGENT 60 l/min | MINERAL OIL |

TABLE 28

| | | ABRASIVE GRAIN PHASE | GRINDING CONDITION | GRINDING FORCE IN NORMAL LINE DIRECTION kg/mm² | GRINDING RATIO | SURFACE ROUGHNESS Ra OF GRINDING MACHINE TO BE GRINDED (μm) |
|---|---|---|---|---|---|---|
| EMBODIMENTS | c1 | $c_1$ | I | 42.3 | 483 | 1.8 |
| | d1 | $d_1$ | I | 34.4 | 476 | 1.7 |
| | g1 | $g_1$ | II | 41.9 | 494 | 1.5 |
| COMPARATIVE EXAMPLES | k1 | $k_1$ | I | 143 | 83 | 19.4 |
| | l1 | $l_1$ | I | 137 | 76 | 20.1 |

TABLE 29

| | | ABRASIVE GRAIN PHASE | MATERIALS OF HUB FLANGE | LOGARITHTIC DECREMENT OF HUB FLANGE MATERIALS | GRINDING FORCE kg/mm² | SURFACE ROUGHNESS Ra OF GRINDING MACHINE TO BE GRINDED (μm) |
|---|---|---|---|---|---|---|
| EMBODIMENTS | a1 | $a_1$ | 12Cr—3Al—Fe STAINLESS STEEL | 0.01 | 44.3 ± 2 | 0.8 |
| | b1 | $b_1$ | 12Cr—3Al—Fe STAINLESS STEEL | 0.01 | 40.1 ± 2 | 0.9 |
| COMPARATIVE EXAMPLES | a1 | $a_1$ | 18Cr—8Ni—Fe STAINLESS STEEL | 0.001 | 43.7 ± 6 | 1.8 |
| | b1 | $b_1$ | 18Cr—8Ni—Fe | 0.001 | 42.9 ± 5 | 1.7 |

TABLE 29-continued

| ABRASIVE GRAIN PHASE | MATERIALS OF HUB FLANGE | LOGARITHTIC DECREMENT OF HUB FLANGE MATERIALS | GRINDING FORCE kg/mm$^2$ | SURFACE ROUGHNESS Ra OF GRINDING MACHINE TO BE GRINDED (μm) |
|---|---|---|---|---|
| | STAINLESS STEEL | | | |

The Embodiments and Comparative Examples mentioned hereinabove obviously reveal that the metal-bonded tool according to the invention, compared to the Comparative Examples, offers advanced grinding characteristics, higher lapping performance, and little wear as a grinding wheels keeping initial conditions, resulting in the grinding wheel which is suitable for grinding and lapping ceramics, hard metal, and so on.

What is claimed is:

1. A metal-bonded tool, comprising:

a base metal portion; and a sinter providing on the base metal portion comprising an iron-base alloy containing carbon or graphite of 2.5 wt %–4.5 wt % and having a grain diameter of 5 μm or less of carbon or graphite precipitates, and abrasive grains.

2. The metal-bonded tool according to claim 1, wherein the diameter of 90% or more said carbon or graphite precipitates does not exceed one tenth of the average diameter of said abrasive grains.

3. The metal-bonded tool according to claim 1, wherein said iron-base alloy further comprises silicon and wherein also the relationship between the quantity of silicon (A wt %) and the quantity of carbon or graphite (B wt %) contained in said iron-base alloy;

$$3 \leqq B + A/3 \leqq 5$$

is satisfied.

4. The metal-bonded tool according to claim 1, wherein the base metal consists essentially of a material having a logarithric decrement (δ) of 0.005 or more.

5. The metal-bonded tool according to claim 1, wherein said iron-base alloy contains 2.5 wt %–4.5 wt % carbon or graphite and 1.0 wt %–3.5 wt % silicon.

6. The metal-bonded tool according to claim 1, wherein either of diamond or cubic boron nitride is used as said abrasive grains.

7. The metal-bonded tool according to claim 1, wherein surfaces of abrasive grains are covered by at least one of nickel, copper and cobalt.

8. The metal-bonded tool according to claim 1, wherein the iron-base alloy includes silicon, carbon or graphite, unavoidable impurities and residual iron.

9. The metal-bonded tool according to claim 1, wherein the iron-base alloy includes at least nickel or cobalt.

10. A method of manufacturing a metal-bonded tool; comprising steps:

mixing Fe-Si alloy powder containing 10 wt %–50 wt % silicon, graphite powder, iron powder and abrasive grains;

sintering the raw powders and abrasive grains on the base-metal.

11. The method of manufacturing according to claim 10, wherein relations between the quantity of the silicon (A wt %) and the quantity of the carbon or graphite (B wt %) in the iron-base alloy;

$$2.5 \leqq B \leqq 4.5$$

$$3 \leqq B + A/3 \leqq 5$$

are satisfied.

12. The method of manufacturing according to claim 11, wherein the iron-base alloy includes 2.5 wt %–4.5 wt % carbon or graphite and 1.0 wt %–3.5 wt % silicon.

13. The method of manufacturing according to claim 11, wherein the abrasive grains include at least one of diamond or cubic boron nitride.

14. The method of manufacturing according to claim 10, wherein sintering is carried out at 1000° C.–1180° C.

15. The method of manufacturing according to claim 10, wherein sintering is carried out using hot pressing at 850° C.–1180° C. under the pressure of 50 kg/cm$^2$ or more.

16. A method of manufacturing a metal-bonded tool, comprising steps:

providing iron-base alloy powder including carbon or graphite of 2.5 wt %–4.5 wt % by the atomizing process;

mixing the iron-base alloy powder and abrasive grains; and sintering the iron-base powder and abrasive grains.

17. The method of manufacturing according to claim 16, wherein said iron-base alloy further comprises silicon and wherein also the relationship between the quantity of silicon (A wt %) and the quantity of carbon or graphite (B wt %) contained in the iron-base alloy;

$$3 \leqq B + A/3 \leqq 5$$

is satisfied.

18. The method of manufacturing according to claim 16, wherein the iron-base alloy contains 2.5 wt %–4.5 wt % carbon or graphite and 1.0 wt %–3.5 wt % silicon.

19. The method of manufacturing according to claim 16, wherein said abrasive grains are used either of diamond or cubic boron nitride.

20. The method of manufacturing according to claim 16, wherein sintering is carried out at 1000° C.–1180° C.

21. The method of manufacturing according to claim 16, wherein sintering is carried out using hot pressing at 850° C. –1180° C. under a pressure of 50 kg/cm$^2$ or more.

* * * * *